US005342032A

United States Patent [19]

Meier

[11] Patent Number: 5,342,032

[45] Date of Patent: Aug. 30, 1994

[54] APPARATUS FOR WIRE-STAPLING MULTI-COMPONENT PRINTED PRODUCTS

[75] Inventor: Jacques Meier, Bäretswil, Switzerland

[73] Assignee: Ferag AG, Hinwil, Switzerland

[21] Appl. No.: 978,129

[22] Filed: Nov. 18, 1992

[30] Foreign Application Priority Data

Dec. 13, 1991 [CH] Switzerland ..... 03 698/91-8

[51] Int. Cl.[5] ..... B27F 7/17; B41L 43/12

[52] U.S. Cl. ..... 270/37; 270/53; 227/81

[58] Field of Search ..... 270/37, 53, 38, 58, 270/54; 227/4, 5, 6, 49, 50, 81, 105, 81; 412/18, 33

[56] References Cited

U.S. PATENT DOCUMENTS

| | | | |
|---|---|---|---|
| 715,890 | 12/1902 | Smyth et al. | 270/58 |
| 3,653,570 | 4/1972 | Alsop | 227/81 |
| 3,762,622 | 10/1973 | Noren | 227/81 |
| 4,750,661 | 6/1988 | Pane | 227/7 |
| 4,792,077 | 12/1988 | Faltin | 227/81 |
| 5,098,002 | 3/1992 | Hänsch et al. . | |
| 5,137,409 | 8/1992 | Honegger | 270/53 X |
| 5,172,897 | 12/1992 | Hansch et al. | 270/53 |
| 5,174,557 | 12/1992 | Meier | 270/37 |

FOREIGN PATENT DOCUMENTS

| | | | |
|---|---|---|---|
| 0399317 | 12/1990 | European Pat. Off. | 270/53 |
| 754923 | 3/1954 | Fed. Rep. of Germany . | |
| 1055499 | 4/1959 | Fed. Rep. of Germany . | |
| 2116734 | 9/1984 | Fed. Rep. of Germany . | |

*Primary Examiner*—Edward K. Look
*Assistant Examiner*—John Ryznic
*Attorney, Agent, or Firm*—McCormick, Paulding & Huber

[57] ABSTRACT

The stitching or stapling heads, which act together in a stitching zone (C) with the supports that carry printed products to be wire-stitched, have a circular orbit. The stitching heads are guided so as to maintain their more or less vertical position during their orbit. Within the stitching zone (C), each stitching head is thus approximately aligned with its respective support and is therefore in the preferred position for driving the staples into the printed products. When the stitching heads encounter the supports, they are pushed back radially inward against the resistance of compression springs. This causes a slight flattening in the orbit of the stitching heads in the stitching zone (C) and slightly prolongs the time available for the stitching heads to act together with the supports in the stitching process.

18 Claims, 7 Drawing Sheets

APPARATUS FOR WIRE-STAPLING MULTI-COMPONENT PRINTED PRODUCTS

BACKGROUND OF THE INVENTION

The present invention relates to an apparatus for wire-stitching or stapling multi-component printed products.

PRIOR ART

An apparatus of this kind is known from EP-A-0 399 317 and the corresponding U.S. Pat. No. 5,172,897 (FIG. 3) wherein the stitching or stapling heads orbit along a circular path whose diameter is much smaller than the diameter of the path of the supports of the printed products that have to be stapled. In the stitching zone, the stitching or stapling heads are guided up to the supports; for the stitching process each moves radially against the outside of its respective support. In this known embodiment, the time available during which a stitching head can act together with its respective support to place and close the staple is relatively short. Further, the angular position as between the support and the stitching head alters while the staples are driven into the printed products and closed.

The same applies to the apparatus described in EP-A-0 205 144 and the corresponding U.S. application Ser. No. 4,750,661. In this known solution, stitching or stapling heads are provided at the ends of four rotating driven arms which move along a circular path and take a metal wire from a cut-wire feed as they pass the cut-wire feed. As the stitching heads move on, this metal wire is then bent into a staple. In the stitching zone, the stitching heads meet the printed products to be stitched, which lie on supports provided in a driven rotating cylinder. In this embodiment, there is likewise little time available for driving in and closing the metal staples. Further, the angular position as between the supports and the stitching heads alters continually while the staples are driven into the printed products and closed.

Besides these, rotary staplers are known in which the stitching is performed by a rotating stitching head and a counter-cylinder fitted with a staple-bender. In the stitching zone, a plunger that moves in the stitching head acts together with the staple-bender which likewise orbits on a circular path. To drive in the staples, the plunger is advanced in an approximately radial direction against the staple-bender. Such rotary staplers likewise provide only a short time to drive in and bend over the staples. Moreover, during the staple-placing process, the plunger continually alters its angular position in relation to the staple-bender. To overcome these disadvantages, it has already been suggested to pivot the plunger during the stitching process, in order to keep it aligned with the staple-bender, in order to drive the staples into the printed products at a favourable angle (DE-PS 21 16 734 and DE-PS 10 55 499).

SUMMARY OF THE DISCLOSURE

The object of the present invention is to propose an apparatus of the type referred to above, but which still permits the proper, correctly positioned stapling of printed products even at high working speeds.

In the stitching zone, the stitching heads are forced back toward the interior of their circular orbit, and this produces a flattening of the circular path in that zone. As a result, the stitching heads can accompany the supports for a certain time. This extends the stitching zone and thus helps to present the staples in the correct position for being driven into the printed products and properly closed.

During the stitching process, the stitching heads are preferably held in a position exactly or approximately aligned with the relevant support, whereby the conditions under which the staples are placed are further improved.

Typical embodiments of the object of the present disclosure are described in greater detail by reference to the drawings attached hereto. These illustrate the present invention in purely diagrammatic form, as follows:

DETAILED DESCRIPTION OF THE PREFERRED EMBODIMENTS

Figure 1:
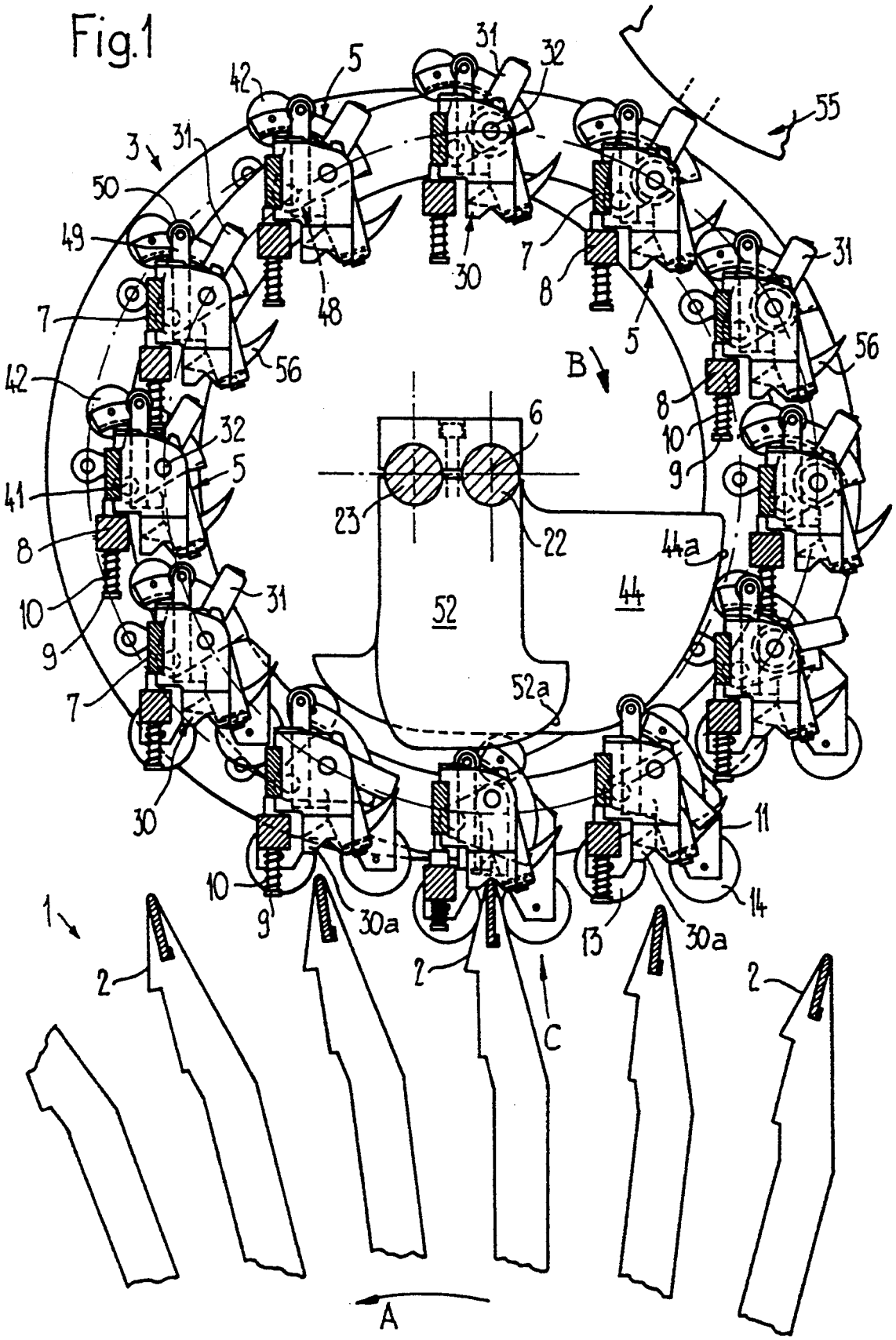
FIG. 1 is a section on line I—I in FIG. 2, and shows a stitching apparatus for a collector drum.
Figure 2:
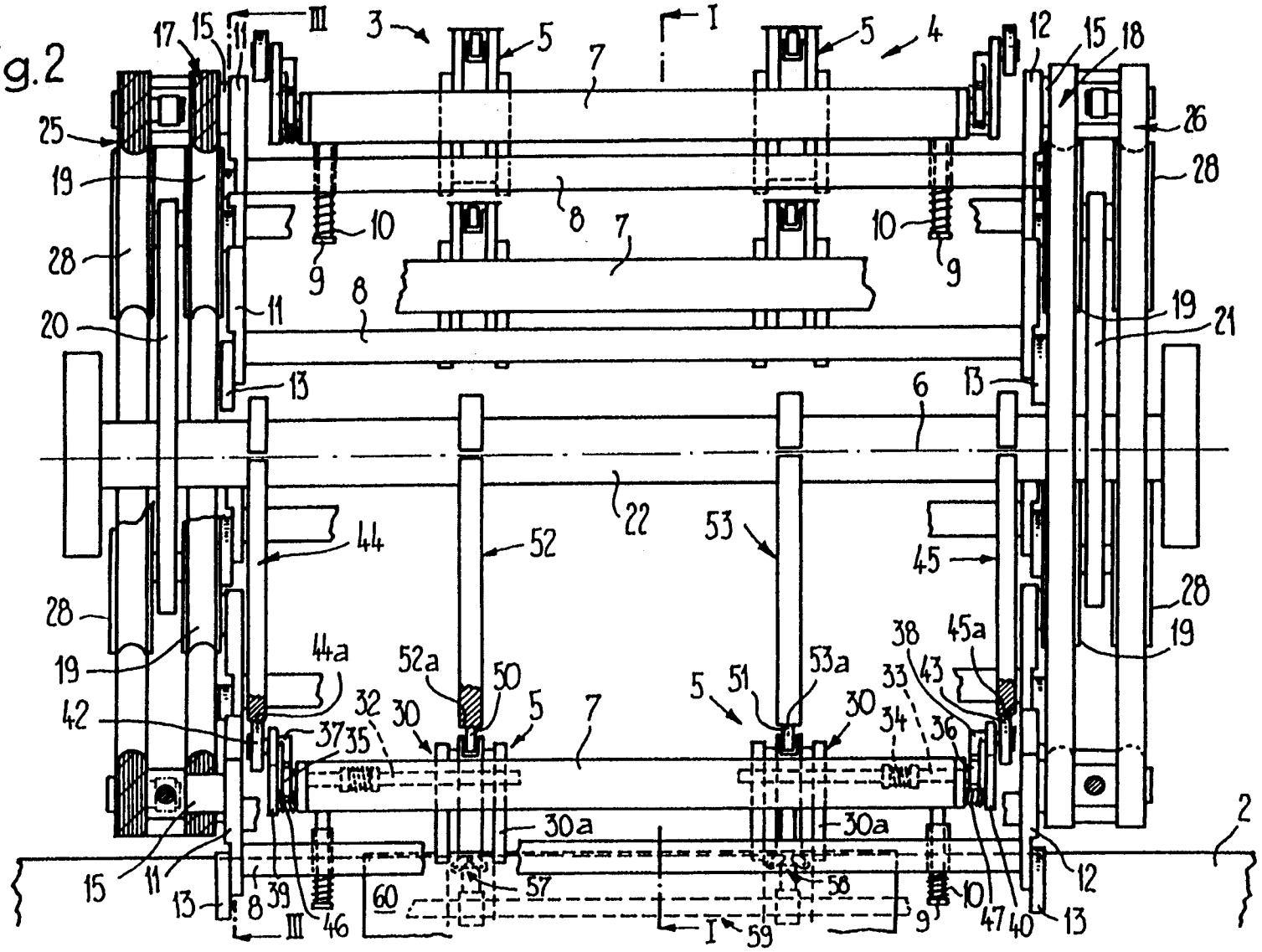
FIG. 2 is a side elevation and partial section of the stitching apparatus shown in FIG. 1.
Figure 3:
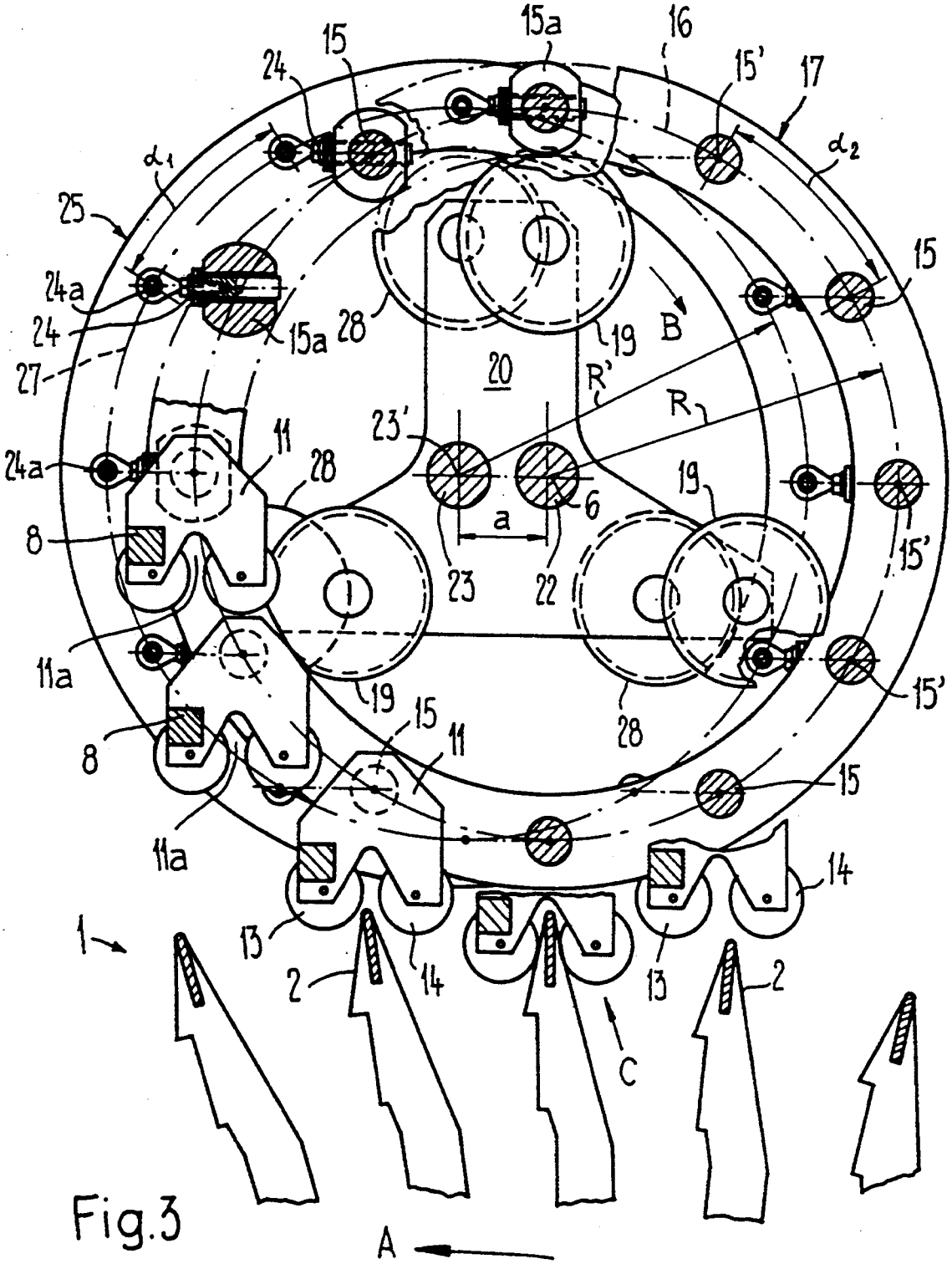
FIG. 3 is a section on line III—III in FIG. 2.

The following description deals first with the general construction of the stitching or stapling apparatus for a collector system, by reference to FIGS. 1 to 3.

The collector drum 1 partly shown in FIGS. 1 to 3 has a number of supports 2 placed at intervals which are driven to rotate in the direction indicated by the arrow A about a rotational axis (not shown on the drawings). The supports 2 extend in length toward their rotational axis. The collector drum 1 as such is of known construction and in essence corresponds with the collector drum described in U.S. Pat. No. 5,172,897. A device for wire-stapling printed products is arranged above this collector drum 1; it has two stitching or stapling systems 3, 4 essentially identical construction and placed at a distance from each other in the direction of the longitudinal axis of the collector drum 1 (FIG. 2).

Each stitching or stapling system 3, 4 has a number of stitching heads 5 of identical construction; their construction and action are described below. The stitching heads 5 have a circular orbit about an orbital axis 6 that runs parallel to the rotational axis of the collector drum 1 and are placed at intervals behind one another in their orbital direction B; as FIG. 1 shows, their spacing corresponds with that between the saddle-shaped supports 2 of the collector drum 1. The stitching heads 5 act in a stitching or stapling zone C together with the supports 2, likewise described in greater detail below.

Each pair of stitching heads 5 is attached to a bearer or carrier 7 that extends parallel to the orbital axis 6. Each bearer 7 can be displaced vertically and is guided in a second bearer or carrier 8 which is likewise parallel to the orbital axis 6. Each bearer 7 has guide bolts 9 that extend down through its respective bearer 8. Compression springs 10 on these guide bolts 9 hold each bearer 7 in its lowest end position where it is closest to its respective bearer 8. At its ends, each bearer 8 has retaining plates 11, 12 with a v-shaped cut-out 11*a* (FIG. 3) whose open end faces down. On the side of the v-shaped cut-outs 11*a*, guide wheels 13, 14 rotate freely in bearings on the retaining plates 11, 12. In the upper part opposite the cut-out 11*a*, the retaining plates 11, 12 are connected to an offset pivot pin 15. The pivot pins 15 on each bearer 8 define a rotational axis 15' for the bearer 8. These rotational axes 15' lie on a pitch circle 16 with a radius R whose centre lies on the orbital axis 6 (FIG. 3). The pivot pins 15 pivot in bearing rings 17, 18 supported on support wheels 19 which can turn freely on a bearing plate 20, 21. The bearing rings 17, 18 can thus rotate about the orbital axis 6. The bearing plates 20, 21 are supported on bearers 22, 23 which run parallel to the orbital axis of the collector drum 1 and whose centers are at a horizontal distance (a) from each other. The longitudinal axis of the bearer 22 is the orbital axis 6.

The pivot pins 15 pass through the bearing rings 17, 18. Each pivot pin 15 has a thickened outer end 15*a* into which a control arm 24 is screwed. The connection between the thickened part 15*a* of the pivot pin 15 and its respective control arm is adjustable but remains fixed after it has been adjusted. Each control arm is held in further bearing rings 25, 26 and can rotate about an axis 24*a*. The rotational axes 24*a* of the control arms 24 lie on a pitch circle 27 whose radius R' is the same as the radius R of the pitch circle 16 of the rotational axes 15' and whose center lies on the longitudinal axis 23' of the bearer 23. The centers of the pitch circles 16 and 27 are therefore at a distance (a) from each other. The interval $d_1$ between the rotational axes 24*a* on the pitch circle 27 is the same as the distance $d_2$ between the rotational axes 15' on the pitch circle 16 (FIG. 3). The bearing rings 25, 26 are supported on supporting wheels 28 which can likewise rotate freely on the bearing plates 20, 21, but on the opposite side to the supporting wheels 19 (cf FIG. 2). The bearing rings 25, 26 can thus rotate about the orbital axis 23' which, as described, is the longitudinal axis of the bearer 23.

The control system formed by the control arms 24 which rotate in the bearing rings 25, 26 about their rotational axes 15' and can pivot the bearers 8 in a known manner as they orbit about the orbital axis 6 and guides them in a parallel and straight line thereto. Thus the stitching heads 5 similarly maintain their essentially vertical position as they orbit about the orbital axis 6. Hence, within the stitching zone C, each stitching head 5 is and remains more or less aligned with its respective support 2 of the collector drum 1.

The following describes the construction and operation of the stitching heads 5, by reference to drawings 1, 2, and 4.

The main features of the stitching heads are those of the stitching head described in FIGS. 1 to 9 of EP-A-0 399 322 and the corresponding U.S. Pat. No. 5,098,002. For a detailed description of the construction and operation of the stitching heads 5, refer to the above publications.

Each stitching head has a carrier element 30 fixed to its respective bearer 7; 30*a* is the lower end zone of each carrier element 30. The carrier element 30 has a pivotable punch 31 which is fixed to but cannot turn on a shaft 32, 33 whose length is parallel in the longitudinal direction with its respective bearer 7 and projects laterally beyond it (FIG. 2). Each shaft 32, 33 has a built-in overload-protection device 34. At the end that projects beyond the bearer 7, a gear 35, 36 is connected to each shaft 32, 33 which meshes with a gear segment 37, 38 whose profile forms a circular arc. Each gear segment 37, 38 is fixed to a lever 39, 40 respectively, which fits on a shaft 41 that can rotate in the carrier element 30. The levers 39, 40 carry a control wheel 42, 43 which acts together with a static template 44, 45 fixed to the bearers 22, 23. 44*a*, 45*a* are the control cams of the templates 44, 45, respectively. Reset springs 46, 47 (FIG. 2) reset the levers 39, 40.

The carrier element 30 also has a movable plunger 48 that moves in an approximately vertical direction and has a actuating arm 49 which in turn has a control wheel 50, 51 respectively at each end. The control wheel 50, 51 acts together with a static template 52, 53 with control cams 52*a*, 53*a*. The templates 52, 53 are likewise fixed to the bearers 22, 23. Reset springs 54 (FIG. 4) are provided for resetting the plungers 48.

A cut-wire dispenser unit 55 is indicated only diagrammatically in FIG. 1. This is fitted on the outside of the orbit of the stitching heads 5. As the stitching heads 5 pass the cut-wire dispenser unit 55, the punches 31 which are in their home position take up a straight length of cut wire from the cut-wire dispenser 55. As the punch 31 pivots clockwise, a bending template 56 bends the length of wire into a U-shaped staple. The bending template 56 is supported on the shaft 32 and lies within the pivoting range of its respective punch 31. To bend the staples after insertion, the supports 2 have pairs of staple-benders 57, 58, indicated only very diagrammatically in FIG. 2. At the appropriate moment, an activating mechanism 59 pivots the staple-benders 57, 58 up and into position (not shown in detail) to bend over the ends of the staples.

The cut lengths of wire are bent into U-shaped staples and the staples thus formed are driven into the printed products 60 that straddle the supports 2 largely in the manner described in detail in EP-A-0 399 322 and the corresponding U.S. Pat. No. 5,098,002 already referred to, hence the following does not describe the stitching process in every detail.

As described, the stitching heads 5 run in the direction indicated by the arrow B on a circular path about the orbital axis 6; in their orbital movement, the stitching heads 5 maintain their approximately vertical position. The collector drum 1 drives the bearing rings 17, 18 and hence the bearing rings 25, 26 as follows: in the stitching zone C, the supports 2 and the printed products 60 astride them engage the retaining plates 11, 12 consecutively between the guide wheels 13, 14. Hence, as the supports 2 rotate in the direction indicated by the arrow A, they entrain the bearing rings 17, 18. At the end of the stitching zone C, the supports 2 disengage from the guide wheels 13, 14.

In the upper part of the orbit of the stitching heads 5, their punches 31 are in the home position, shown in FIG. 1 by a continuous line; in the home position the plungers point obliquely up and forward in the direction of rotation. As the punches 31 pass the cut-wire dispenser unit 55, they take up a straight length of cut wire, as described.

Figure 4:
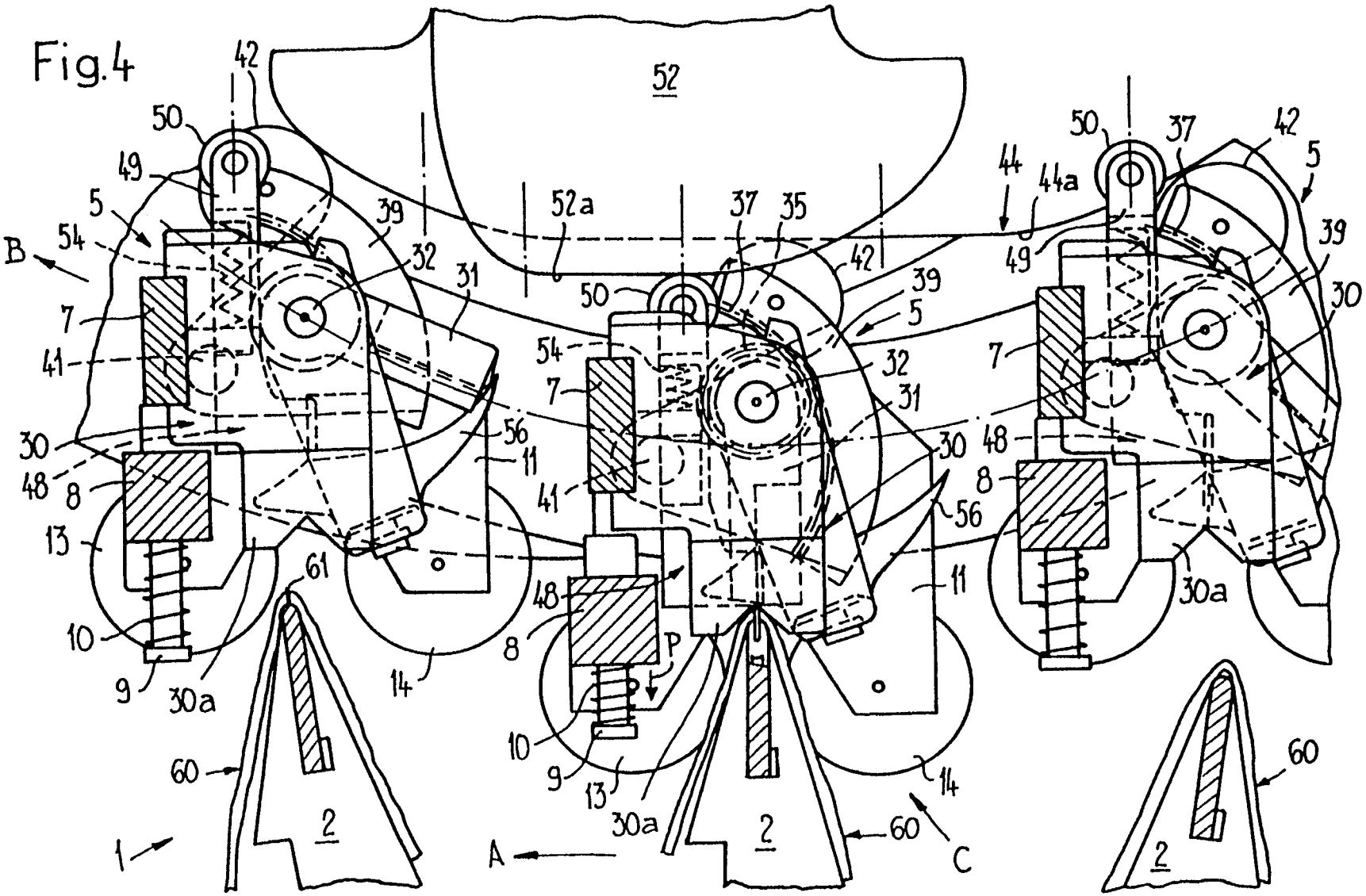
FIG. 4 shows at a larger scale the stitching apparatus in the stitching zone shown in FIG. 1.

As the control wheels 42, 43 start to run on the control cams 44*a*, 45*a* of the templates 44, 45, the punches 31 move clockwise out of their home position into the staple-placing position, shown by a dashed line in FIG. 4. During this pivoting movement, the lengths of cut wire are guided over the bending template 56 and bent into U-shaped staples.

As the stitching heads 5 reach the stitching zone C, the lower end zone 30*a* of their carrier elements 30 comes into contact with the supports 2, i.e. the printed products 60 that lie on these supports 2 (as shown particularly in FIG. 1 and FIG. 4). The circular path on which the ends of the supports 2 are moving and the path on which the lower end zones 30*a* of the carrier elements 30 are moving intersect, i.e. they are so adjusted relative to each other that, as the stitching heads 5 come into contact with the supports 2, they and their respective bearers 7 are pushed back and up against the compression springs 10 and the resetting force P that these exert (FIG. 4). This flattens the circular orbit of the stitching heads 5 in the stitching zone C and thus prolongs the time that the stitching heads 5 and the supports 2 can act together.

When the control wheels 50, 51 start to run on the control cams 52*a*, 53*a* of the templates 52, 53, the plungers 48 move vertically into position for driving in the staples. The staple that each punch 31 holds ready for placing in position is thus driven into the printed product 60 that straddles the respective support 2. The staple-benders 57, 58 pivot up and into position to close the staples.

After the stitching heads 5 leave the stitching zone, the control wheels 50, 51 run off their respective templates 52, 53. As a result, the reset springs 54 reset the plungers 48 in their home position. The punches 31 likewise pivot back into their home position when the control wheels 42, 43 leave their respective templates 44, 45.

Figure 5:
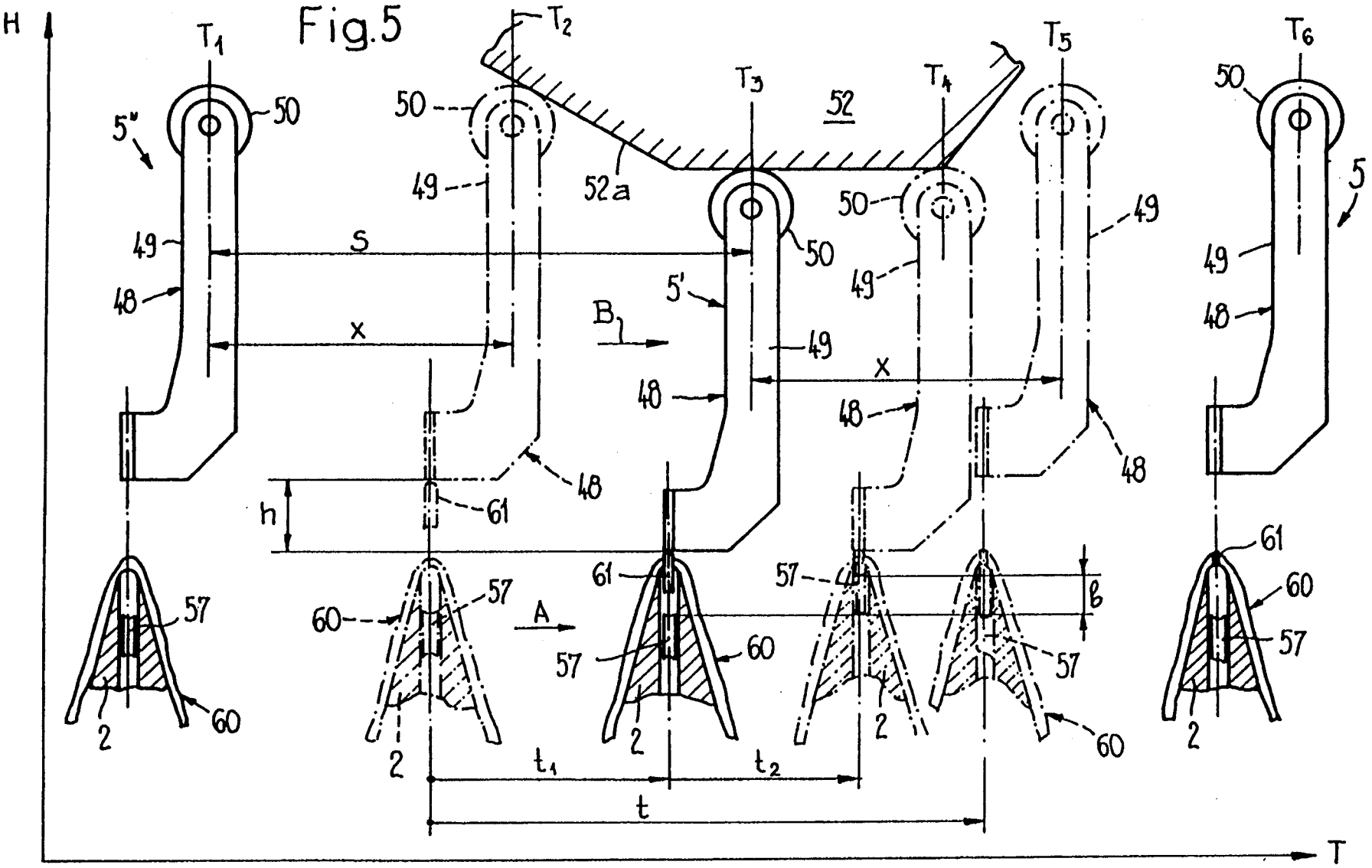
FIG. 5 is a diagrammatic representation of the stitching process.

The following refers to FIG. 5, which shows only the plunger 48 of the stitching head 5 and the activating arm 49, and describes in greater detail the time sequence of the staple-placing process.

In FIG. 5, the abscissa shows the time T and the ordinate indicates the plunger stroke H. FIG. 5 does not show the punch 31 which is in position for placing the staple. Note: in FIG. 5, the direction B of the movement of the plunger 48 is from left to right, i.e. contrary to that shown in FIGS. 1, 2, and 4.

From position $T_1$ in FIG. 5, the stitching head moves to position $T_2$ where the control wheel 50 of the plunger 48 comes into contact with the control cam 52*a* of the template 52. This starts the downward movement of the plunger 48 and is the beginning of the period $t_1$ during which the staple 61 is driven into the printed product 60. This driving-in process ends when the plunger 48 reaches the position $T_3$. During the driving-in process the plunger 48 performs the stroke (h).

After the staple is driven into place, the staple-closing stage $t_2$ begins. In this, the plunger 48 remains lowered in the position for driving in the staple, while the pair of staple-benders 57 pivots up and bends over the ends of the staples. The staple-closing process ends when the plunger reaches position $T_4$, the pair of staple-benders 57 pivot back, and the control wheel 50 leaves the control cam 52*a* of template 52. This causes the plunger 48 to move back up to its home position as it reaches position $T_5$; (b) is the stroke of the pairs of staple-benders 57.

FIG. 5 shows that the entire process of placing the staple which consists of the driving-in stage $t_1$ and the staple-closing stage $t_2$ is shorter than the period (t) during which the plunger 48 moves from the home position into position for driving in the staple and back again into its home position. In other words, when it has inserted and closed a staple, the plunger 48 is on its way back or has returned to its home position before the plunger 48 of the next stitching head moves out of its home position into position for driving in the staple.

FIG. 5 also shows this in another way by indicating the relative positions of successive stitching heads at a given point in time, i.e. a first stitching head 5 at $T_6$ has already left the stitching zone C, the plunger 48 of the next stitching head 5' at $T_3$ is in position for driving in the staples, and a third stitching head 5'' at $T_1$ is about to enter the stitching zone C. The plungers 48 of the three stitching heads 5, 5', and 5'' are drawn with a continuous line; the intermediate positions are shown by a dot-dashed line. In FIG. 5, (s) is the interval between two consecutive stitching heads.

After a period (t), the stitching head 5'' is at $T_3$ and the stitching head 5' is at $T_6$. When the stitching head 5'' has moved by an amount (x) and arrived at $T_2$, the stitching head 5' in front of it is at $T_3$, after likewise moving by an amount (x).

Figure 6:
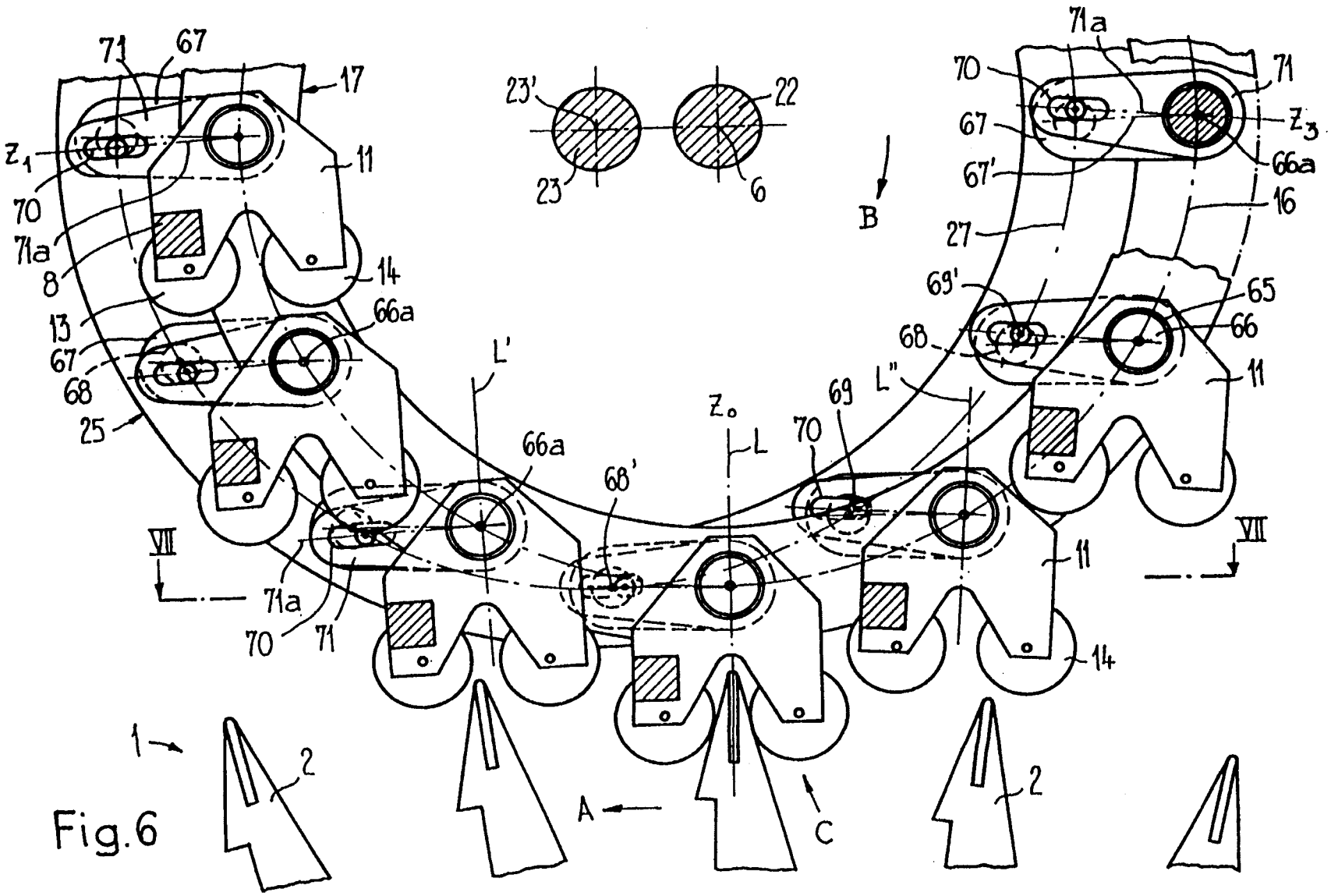
FIG. 6 shows another embodiment for controlling the position of the stitching heads, corresponding with FIG. 3.
Figure 7:
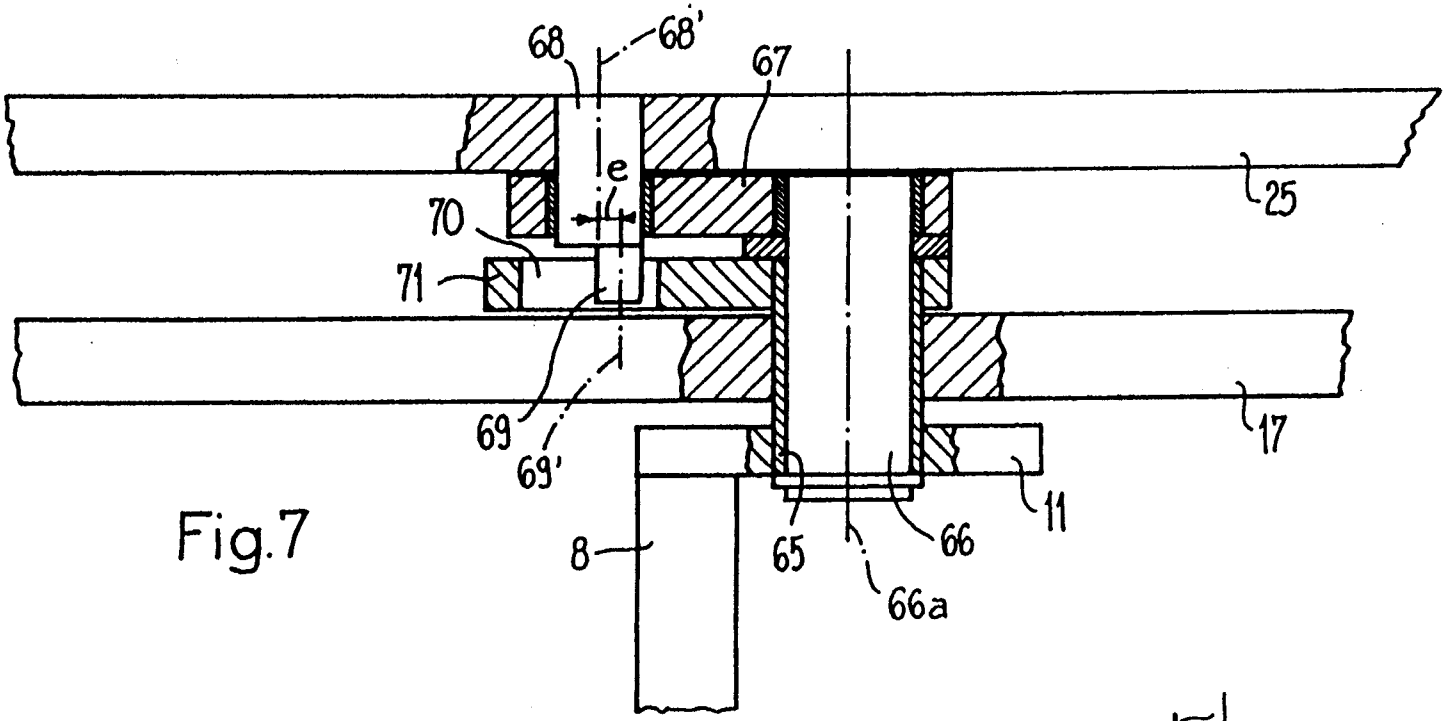
FIG. 7 is a section on line VII—VII in FIG. 6, at a larger scale.
Figure 8:
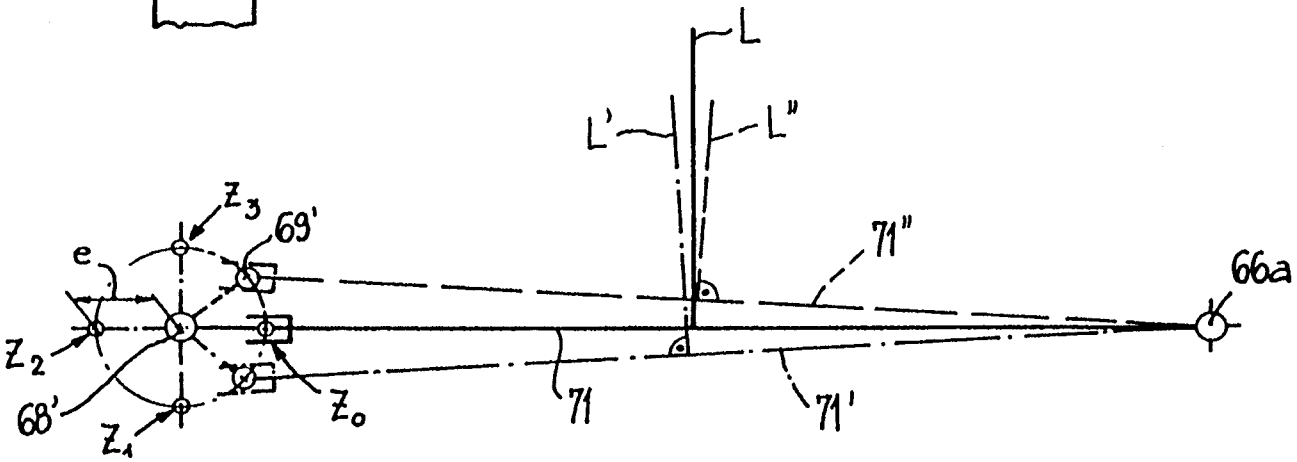
FIG. 8 is a diagrammatic representation of the change in the position of the stitching heads as they orbit.

Because each stitching head 5 remains approximately aligned with its respective support 2 during the staple-placing process, it makes it possible to drive in the staples in their correct position although the time available for placing them is relatively short. In the present example, the stitching heads 5 remain approximately vertical and move along with the supports 2 for a certain time. As described, this is achieved because each support 2 forces back its respective stitching head 5 and thus flattens the orbit of the stitching heads 5. FIGS. 6 to 8 inclusive describe another embodiment of the means of controlling the position of the stitching heads 5 in their orbit about the orbital axis 6. In these figures, components identical with those in FIG. 3 have the same reference numbers.

In this embodiment, shown in greater detail in FIGS. 7 and 8, the bearers 8 and hence the stitching heads 5 are no longer guided parallel to themselves during their orbit, as in the embodiment shown in FIGS. 1 to 5 inclusive, but pivot by a certain amount on their pivotal axis. This is achieved by a slightly different system of support for the retaining plates 11, 12 in their respective bearing rings 17, 18 and by a different type of control link to the other bearing ring 25, 26. FIGS. 6 and 7 show the system of support of the retaining plates 11 in the two bearing rings 17 and 25. This is also typical for the bearings for the other retaining plates 12 in the other two bearing rings 18 and 26.

A rotary sleeve 65 is connected to each retaining plate 11 but cannot turn therein. The rotary sleeve 65 extends through the bearing ring 17 and is held on a bearing bolt 66 that allows it to rotate, and thus likewise extends through the bearing ring 17. Each bearing bolt 66 defines a rotational axis 66*a* for the retaining plates 11 and thus also for the bearers 7 and 8 and the stitching heads 5. The rotational axes 66*a* correspond with the rotational axes 15' of the embodiment shown in FIGS. 1 to 5 and, like the rotational axes 15', they lie on the pitch circle 16, likewise at an interval $d_2$. Further, a control lever 67 can likewise rotate on each bearing bolt 66; its other end can rotate on a bearing bolt 68 which is firmly anchored in the bearing ring 25. Each bearing bolt 68 defines the rotational axis 68' of its respective control lever 67. The control levers 67 and their rotational axes 68' correspond with the control arms 24 and their rotational axes 24*a* of the embodiment shown in FIGS. 1 to 5. Like the rotational axes 24*a*, the rotational axes 68' lie on the pitch circle 27 at an interval of $d_1$. The longitudinal axis 67' (FIG. 6) of the control levers 67 is always horizontal.

On its end that faces the bearing ring 17, the bearing bolt 68 has an eccentric tenon 69 whose longitudinal axis 69' is offset by a distance (e) relative to the bearing bolt 68. As shown in FIG. 6, the tenon 69 is so positioned that its longitudinal axis 69' also lies on the pitch circle 27. The tenon 69 engages in a longitudinal slot 70 in a lever 71 which is connected to but cannot turn about the rotary sleeve 65; 71*a* is the longitudinal axis of the lever 71 (FIG. 6). The connection between the lever 71 and the retaining plate 11 is rigid and does not allow the two components to turn relative to each other.

The following refers to FIG. 8 to describe the operation of the embodiment shown in FIGS. 6 and 7.

In FIG. 8, L is the longitudinal axis, i.e. the axis of symmetry, of the retaining plates 11; $Z_0$ to $Z_3$ are the various positions of the retaining plates 11 in their orbit.

As described, the control levers 67 remain horizontal during their orbit. The longitudinal axes 68' and 69' of the bearing bolts 68 and the tenons 69 respectively move along the pitch circle 27.

When the retaining plates 11 are in their bottom position $Z_0$, the levers 71 are horizontal, i.e. the longitudinal axis L of the respective retaining plate 11 is vertical. In this position $Z_0$, therefore, the position of the stitching heads 5 is likewise vertical, i.e. each is exactly aligned with its respective support 2. As the stitching head 5 continues to rotate, the lever 71, guided by the eccentric tenon in the longitudinal slot, pivots counterclockwise out of its horizontal position. This causes the corresponding retaining plate 11 and hence also the stitching heads coupled to it to pivot likewise. The longitudinal axis L' of the retaining plates 11 is thus inclined relative to the vertical. The stitching head 5 therefore remains aligned with its respective support 2 which likewise moves out of its vertical position at $Z_0$. As already described by reference to FIGS. 1 to 5, the retaining plates 11 and their guide wheels 13, 14 disengage from the supports.

In the nine o'clock position $Z_3$ (FIG. 6), the levers 71 are in their lowest pivoting position. As they continue to rotate in direction B, the levers 71 and thus the stitching heads 5 pivot back. In the twelve o'clock position $Z_2$ (not shown in FIG. 6), the levers 71 are again horizontal.

When they rotate to In the three o'clock position $Z_3$, the levers pivot clockwise and up. In this position $Z_3$, the levers 71 have come to their raised end position. From this raised end position, the levers 71 and hence the stitching heads 5 pivot back counterclockwise, until the levers 71 move back to horizontal in the six o'clock position $Z_0$. When they arrive in the stitching zone C, the retaining plates 11 and their respective stitching heads are slightly tilted relative to the vertical, as shown by L" which indicates the longitudinal axis of the retaining plates 11. Each stitching head is thus aligned with its respective support 2, which in this position of its rotary movement likewise forms a slight angle with the vertical.

In the embodiment in accordance with FIGS. 6 to 8, the position of the retaining plates 11 and hence also of the stitching heads remains more or less vertical, but they pivot slightly out of the vertical in both lateral directions, as described. The amplitude of this pivot movement is defined by the amount of eccentricity (e). As a result, each stitching head 5 remains exactly aligned with its respective support 2 and thus stays in its preferred position relative to the printed product and the staple benders 57, 58 for placing the wire staples 61.

Out of the many possible combinations and permutations of the embodiments described above, only a few special forms are described below:

For example, it would be feasible to keep the stitching heads vertical only while they are in the stitching zone C, rather than, as shown, throughout their orbit.

A design that, as shown, provides for the stitching heads 5 to be driven by the supports 2 of the collector drum 1, is particularly straightforward. However, the stitching heads can also be driven indirectly by a drive system of their own, but in that case this should preferably be coupled to the drive of the collector drum 1.

The stitching heads may also be of a different but known type.

The cut-wire dispenser unit 55 may also be of a kind that dispenses pre-bent U-shaped staples to the punches 31 of the stitching heads 5. In such an embodiment the bending template 56 can be omitted.

It It is also possible to use more than two stitching systems 3, 4 for printed products 60 that require three or more wire staples 61. The stitching systems 3, 4 may also be offset relative to each other in the direction of the circumference of the collector drum 1.

Finally, in lieu of a collector drum, a different embodiment of a conveyor system may be provided for the printed products due to be wire-stitched, whose supports 2 do not rotate about a rotational axis but have a longish path, as shown, for example, in FIG. 4 of EP-A-0 399 317 and the corresponding U.S. Pat. No. 5,172,897.

I claim:

1. Apparatus for wire-stapling multi-component printed products comprising: saddle-shaped supports arranged parallel to each other and moving in a closed orbit or path and extending approximately at right angles to their orbital movement (A), said orbit or path passing through a stapling zone (C) and being disposed at one side of the stapling zone; at least one stapling system with a number of stapling heads for placing wire staples in position, the stapling heads being designed and located to encounter the supports within the stapling zone (C), and moving in a closed orbit which is circular outside of the stapling zone at approximately the same speed as the supports; the stapling heads being placed at intervals behind one another in the direction of their movement (B), which intervals correspond with the intervals between adjacent supports, and the stapling heads also being resiliently mounted on carriers movable in a closed circular orbit at the side of the stapling zone opposite from the closed orbit of the saddle-shaped supports so that when the stapling heads encounter the respective supports in the stapling zone (C), the supports force the stapling heads resiliently out of their otherwise circular orbit and inwardly with respect to the closed circular orbit of the carriers.

2. Apparatus in accordance with claim 1, wherein control means are connected with the stapling heads for holding the heads approximately in the same orientation relative to the respective supports during the stapling process.

3. Apparatus in accordance with claim 1, wherein the stapling heads are resiliently mounted on the carriers by springs which exert a resetting force (P) in opposition to the supports.

4. Apparatus in accordance with claim 1, wherein the stapling heads are held by and turn in a bearing system parallel to their orbital axis and rotate about respective rotational axes which are parallel to the orbital axis, and a control system controls the rotational position of the stapling heads in their orbit.

5. Apparatus in accordance with claim 4, wherein the control system, (and to) has a control element that rotates about a rotational axis offset relative to the orbital axis, is driven driven synchronously with the bearing system, and has control levers that pivot on pivot pins about the rotational axes of the stapling heads and are coupled to the bearing system.

6. Apparatus in accordance with claim 5, wherein the rotational axes of the control levers lie on a pitch circle whose radius (R') is equal to the radius (R) of the pitch circle of the rotational axes of the stapling heads, and the distance ($d_1$) between the rotational axes of the control levers is equal to the distance ($d_2$) between the rotational axes of the stapling heads.

7. Apparatus in accordance with claim 5 wherein the control levers are connected rigidly to the pivot pins that define the rotational axes of the stapling heads, and the pivot pins are held by and are free to turn in the bearing system.

8. Apparatus in accordance with claim 5, wherein each stapling head is rigidly connected to a bearing element held by and free to turn in the bearing system about the rotational axis of the stapling heads, and the bearing element is coupled to an eccentric drive that follows the control element to pivot the stapling head between two end positions.

9. Apparatus in accordance with claim 5, wherein the bearing system has two bearing elements at a distance from each that rotate about the orbital axis; each of the carriers for the stapling heads includes pivot pins holding a first elongated carrier member parallel to the orbital axis; and the stapling heads are held on the carrier members.

10. Apparatus in accordance with claim 9, wherein each carrier further includes a second elongated carrier member extending parallel to the first carrier member and resiliently supported from the first carrier member by resetting springs; and the stapling heads are attached to the second carrier members.

11. Apparatus in accordance with claim 4, wherein the bearing system is driven by the action of the orbiting supports.

12. Apparatus in accordance with claim 9, wherein the first carrier members are connected to catching elements that engage the supports in the stapling zone (C).

13. Apparatus in accordance with claim 5, wherein the bearing system is made of rings that rotate at their inner sides on bearings.

14. Apparatus in accordance with claim 1, wherein each stapling head has a punch for feeding wire staples to the stapling zone (C); a control system pivots the punch between its home position and the position for placing the staples; a plunger drives a wire staple into a printed product presented on a support; and a further control system moves the plunger between its home position and the position for driving the wire staple into the printed product when the punch is in position for placing the staple.

15. Apparatus in accordance with claim 14, wherein a static cut-wire dispensing unit is placed on the outside of the orbit of the stapling heads and dispenses a length of wire to each punch in its home position as it passes the dispensing unit; and each length of cut wire extends substantially at right angles to the orbital motion of the stapling heads.

16. Apparatus in accordance with claim 15, wherein a bending element is provided on each stapling head in the path of the punch for forming a U-shaped staple out of the length of cut wire carried past by the punch.

17. Apparatus in accordance with claim 14, wherein the control system for the plungers is made in such a way that the plunger of a stapling head moves back from the position for driving in a staple before the plunger of the subsequent stapling head moves out of its home position and into position for driving in a staple.

18. Apparatus in accordance with claim 1, wherein a staple-closing system assigned to a stapling system has a number of counter-elements fitted to the supports which act together with the stapling heads in the stitching zone (C) to close the inserted wire staples.

* * * * *